US005494086A

United States Patent [19]

McBrady et al.

[11] Patent Number: 5,494,086

[45] Date of Patent: Feb. 27, 1996

[54] BOTTLE FILLING MACHINE

[75] Inventors: Garrett McBrady, Frankfort; Julian Avelis, Peotone, both of Ill.

[73] Assignee: McBrady Engineering, Inc., Joliet, Ill.

[21] Appl. No.: 287,402

[22] Filed: Aug. 8, 1994

[51] Int. Cl.[6] ..... B65B 3/00

[52] U.S. Cl. ..... 141/163; 141/62; 141/92; 141/144; 134/159

[58] Field of Search ..... 141/91, 92, 144, 141/163, 34, 62, 89, 135, 164; 134/159

[56] References Cited

U.S. PATENT DOCUMENTS

| | | | |
|---|---|---|---|
| 1,218,315 | 3/1917 | Redd | 141/144 |
| 2,896,647 | 7/1959 | Thomson, Jr. | 134/159 X |
| 2,908,124 | 10/1959 | Hagen | 141/91 X |
| 4,387,747 | 6/1983 | Franek et al. | 141/163 X |
| 4,834,123 | 5/1989 | McBrady | 134/159 X |
| 5,163,487 | 11/1992 | Clusserath | 141/92 |
| 5,337,796 | 8/1994 | Ohmori et al. | 141/144 X |
| 5,398,734 | 3/1995 | Hartel | 141/92 X |

*Primary Examiner*—J. Casimer Jacyna
*Attorney, Agent, or Firm*—Ernest Kettelson

[57] ABSTRACT

A bottle filling machine comprising a rotary spoke assembly rotating in a vertical plane on a horizontal axis carries bottles between each spoke with their open necks facing radially inward toward the central axis of the rotating spoke assembly. A valve assembly is positioned around the central axis of the rotary spoke assembly, having a rotating valve cup which rotates with the spoke assembly and bottles carried between the spokes. Filler tubes extend from discharge apertures through the rotating valve cup to the open necks of the bottles. The valve assembly includes a stationary valve plate which bears against a corresponding bearing face of the valve cup. An inlet aperture and inset distribution groove of the valve plate flows distilled water or other fill material to and through the discharge apertures of the rotating valve cup as they rotate past to thereby fill the bottles. Such inlet aperture to fill the bottles is positioned to flow fill material through the discharge apertures of the rotating valve cup and into the bottles when they reach the lower semi-circular half of the operating revolution, at which time the open necks of the bottles are above the horizontal so the fill material will not drain out. Additional inlet apertures and inset distribution grooves are provided in the stationary valve plate for delivering rinse water and pressurized air to the bottles while in the upper semi-circular half of the operating cycle, at which time the bottles are inverted enabling the rinse water to automatically drain out.

23 Claims, 9 Drawing Sheets

BOTTLE FILLING MACHINE

BACKGROUND OF THE INVENTION

This invention relates to the field of bottle filling machines for use in assembly line operations wherein a conveyor feeds empty bottles to the bottle filling machine and the bottles are discharged back on to the conveyor after being filled.

Prior art of which the inventors are aware include those machines disclosed in the following United States patents.

U.S. Pat. No. 4,944,810 in which William J. McBrady is the inventor discloses a bottle washer machine in which bottles are washed, emptied and dried as they are rotated in a vertically positioned circular path.

U.S. Pat. No. 4,834,123 in which William J. McBrady is the inventor discloses a bottle washer machine similar to that disclosed in U.S. Pat. No. 4,944,810.

U.S. Pat. No. 3,159,164 in which Joseph K. McBrady is the inventor, discloses a container cleaning machine which is similar to those disclosed in U.S. Pat. Nos. 4,944,810 and 4,834,123.

U.S. Pat. No. 4,387,747 discloses a high speed rotary filling machine in which containers are rotated through a circular path during which they are filled from a filling head which rotates with the containers.

U.S. Pat. No. 3,659,634 discloses a device for filling individual receptacles with a metered quantity of a flowable material. The material is fed by gravity into containers below.

U.S. Pat. No. 2,908,124 discloses a machine for handling ampules and the like during the washing, drying, sterilizing, filling and sealing operations.

U.S. Pat. No. 1,218,315 discloses a machine for filling cylindrical packages or cans with pulverulent material as they are carried around a curvilinear path.

U.S. Pat. No. 1,811,908 discloses a combined drainer and siruper for use in the canning industry and particularly for packing fruits and berries, which includes a rotatable wheel having a plurality of turrets for holding the cans, and means to support the turrets in the plane of rotation during part of the revolution of a wheel and to move the turrets in a plane radial of the wheel and out of the plane of rotation during another part of the rotation.

U.S. Pat. No. 1,202,171 discloses a fruit can draining machine comprising a rotary spoke assembly, vertically movable arms pivoted thereto, a cap to support a can in place on each arm, and a cam assembly to turn the cans below the horizontal to drain liquids therefrom.

U.S. Pat. No. 1,094,380 discloses a process for use in sterilizing milk bottles as they are carried on a conveyor line.

U.S. Pat. No. 955,551 discloses a bottling machine having a plurality of carriers to receive bottles for washing, filling, closing and labeling while in the carriers, and an intermittent drive mechanism to move the carriers from station to station with intervals of non-movement for processing.

U.S. Pat. No. 837,559 discloses a fruit washing machine to wash fruit after being placed in cans, comprising a tiltable carrier in which cans are clamped and guide members which invert the cans during travel after which they are moved back to an upright position.

U.S. Pat. No. 722,263 discloses an apparatus for bottling liquids, including a carrier rotatable in a vertical plane having transverse rows of bottle holders, the carrier being rotated beneath bottle filling tubes, and a lifting mechanism to raise and lower the tubes for inserting into and withdrawing from the bottles.

U.S. Pat. No. 522,396 discloses a machine for mixing gases with liquids such as carbonating beverages, comprising a bottle supporting frame rotated with a hollow rotating shaft in which gas is flowed under pressure, and a check valve mechanism connected to charge the liquid filled bottles with such gas.

SUMMARY OF THE INVENTION

The bottle filling machine in accordance with the present invention provides a number of improvements over the prior art. The bottles are received at the lowest portion of a vertically extending rotary spoke assembly and rotated through one or more revolutions during which they may be rinsed and dried by injecting pressurized air during the upper semi-circular half of the revolution. At such time, the open mouths of the bottles are below the horizontal and thereby drain automatically. When the bottles reach the lower semi-circular half in which their open mouths are above the horizontal so they will retain material fed therein, the machine in accordance with the present invention then fills the bottles prior to their returning to the lowest portion of the rotational path. When they reach that point the filled bottles are discharged back on to the conveyor line.

The bottle filling machine in accordance with this invention includes a valve assembly having a stationary valve plate and a rotatable valve cup which rotates with the rotary spoke assembly and bottles carried by the spokes and their separator pads around the cylindrical drum in which the rotary spoke assembly is mounted. Filler tubes extend from a plurality of discharge apertures spaced apart radially around the rotatable valve cup to respective ones of the bottles between each adjacent pair of spokes.

A filler inlet aperture through the stationary valve plate is connected to a supply of material with which the bottles are to be filled, such as distilled water. By locating such filler inlet aperture of the stationary valve plate at the three o'clock position in a spoke assembly viewed in clockwise rotation, the fill material begins to flow through the rotating discharge apertures and filler tubes after the bottles carried between the spokes have reached the lower half of the semi-circle in which their mouths are above the horizontal and thus able to retain what is being fed into the bottles.

The stationary valve plate has an arcuate distribution groove insert opening to its bearing surface which bears against the corresponding bearing surface of the rotating valve cup. The insert arcuate groove extends in an arcuate path corresponding to the circular path in which the discharge apertures of the rotating valve cup are located, and such arcuate groove extends from the three o'clock position to about the five o'clock position. Thus, distilled water or other fill material is flowed through the fill inlet aperture at the three o'clock position into the inset arcuate groove which extends to the five o'clock position whereby all of the discharge apertures facing the arcuate groove between the three o'clock and five o'clock positions as they rotate past, carry fill material into the respective bottles to which they are connected.

After the discharge apertures rotate past the five o'clock position and the end of the inset arcuate groove, the bearing surface of the stationary valve plate against the bearing surface of the rotating valve cup, they are sealed off and nothing can flow through the filler tubes until the discharge apertures again face either an inlet aperture through the stationary valve plate or an inset arcuate groove in communication with an inlet aperture.

Additional inlet apertures and inset arcuate grooves connected to a supply of rinse water in the first instance and to a source of pressurized air in the second instance, are provided in the upper semi-circular half of the stationary valve plate, such as from the ten o'clock to eleven o'clock position for the rinse inlet aperture and inset groove, and from the one o'clock to two o'clock position for the pressurized air inlet aperture and inset groove. As the discharge apertures of the rotating valve cup pass these apertures and distribution grooves respectively, rinse water is first flowed into the bottles while they are in the upper semi-circular half of the revolution and in the inverted position whereby the rinse water can automatically drain out by gravity. Then pressurized air is flowed into the bottles for drying before reaching the three o'clock position where filling begins and continues until the bottles reach the five o'clock position just prior to discharge back on to the conveyor line.

Modification of the invention provide additional improvements over the prior art, including one modification in which each bottle is rotated through two separate orbits. In one orbit, the bottles are washed with a detergent, and then filled during the second orbit.

In another modification, two side-by-side circular rows of bottles are carried around the cylindrical drum by the rotary spoke assembly, for rinsing, aerating and filling of two sets of bottles during each revolution.

Other improvements and advantages of the bottle filling machine in accordance with the present invention will become apparent from the more detailed description which follows and from an examination of the accompanying drawings.

DESCRIPTION OF PREFERRED EMBODIMENT

Figure 1:
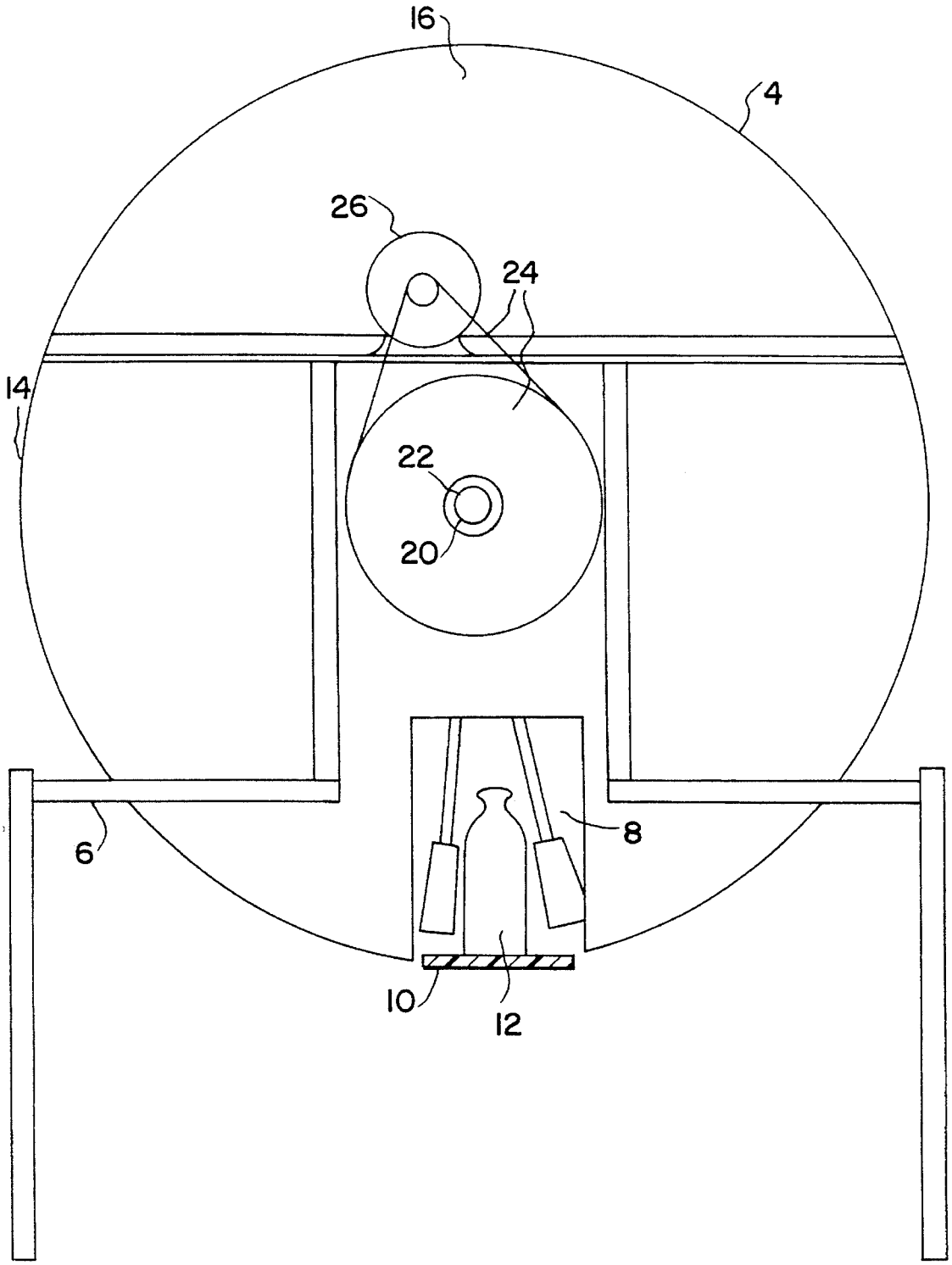
FIG. 1 is an elevation view from the back of a bottle filling machine in accordance with this invention.
Figure 2:
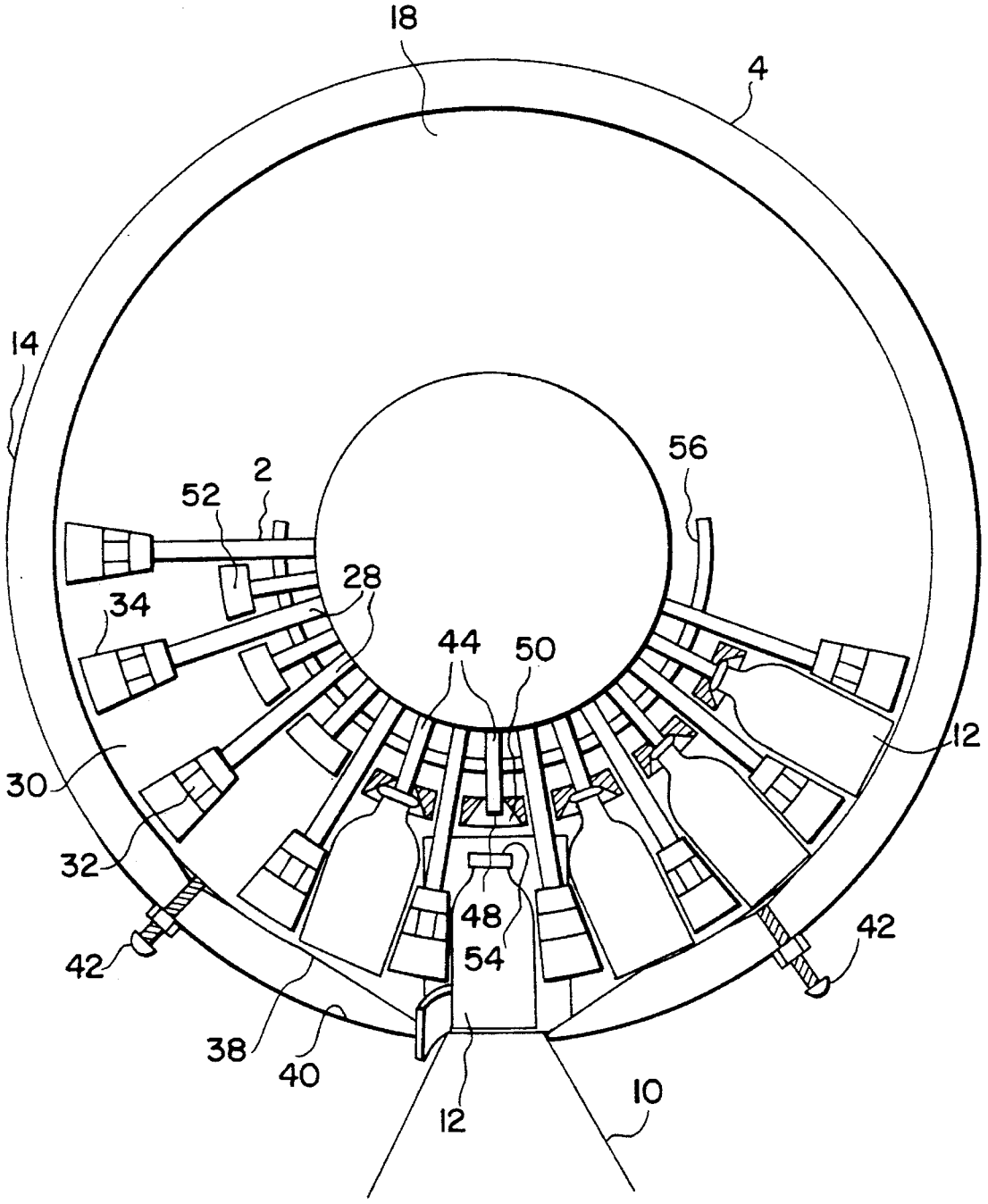
FIG. 2 is an elevation view from the front of the cylindrical drum and rotary spoke assembly of the bottle filling machine.
Figure 3:
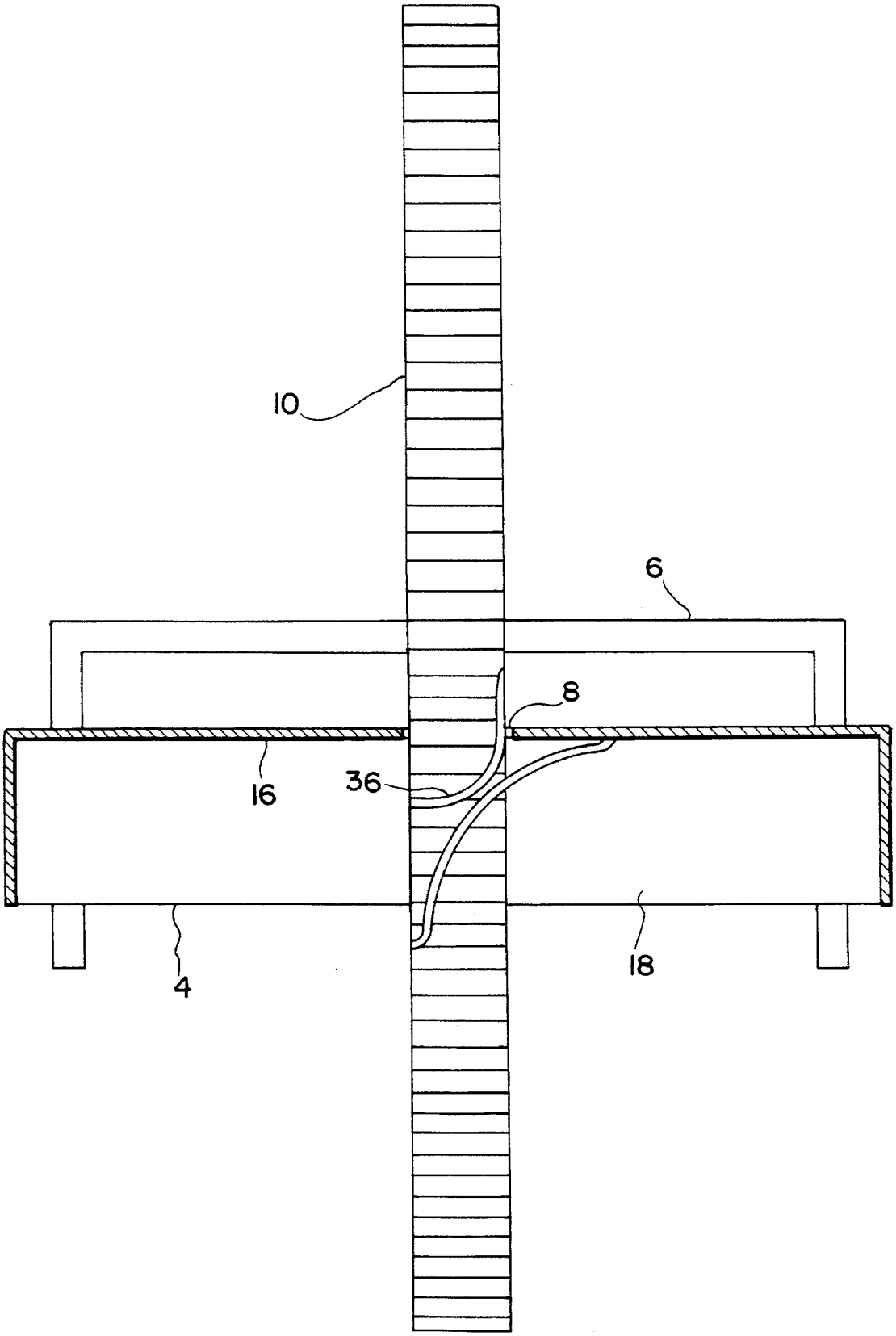
FIG. 3 is a plan view of the conveyor line extending through the cylindrical drum, the upper part of the drum being cut away to illustrate the guide rails which direct the bottles into the path of the rotary spoke assembly and back on to the conveyor after being filled.
Figure 4:
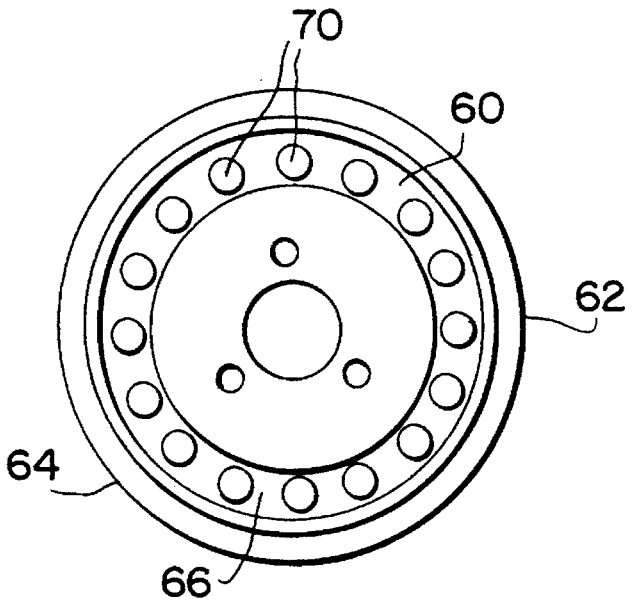
FIG. 4 is a plan view of the valve cup component of the valve assembly.
Figure 5:
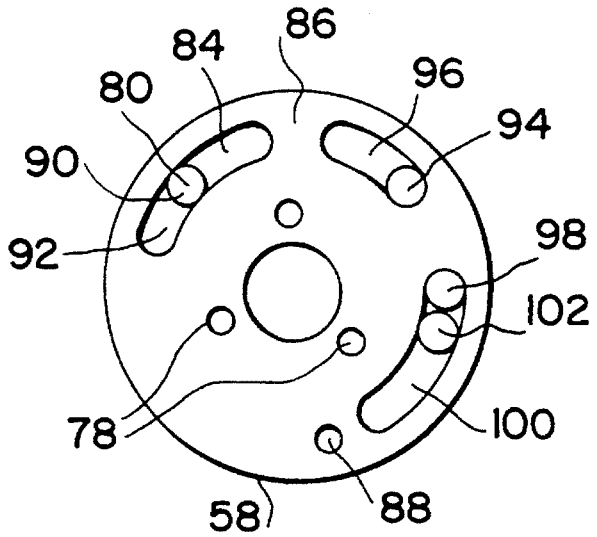
FIG. 5 is a plan view of the valve plate component of the valve assembly.
Figure 6:
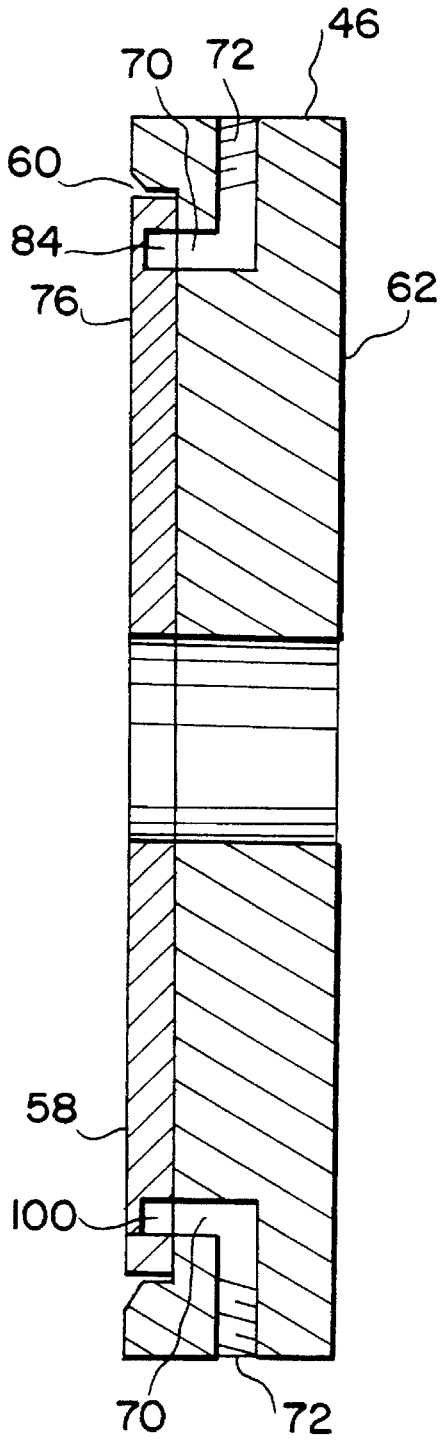
FIG. 6 is a section view of the valve assembly showing the valve plate in place on and bearing against the valve cup.
Figure 7:
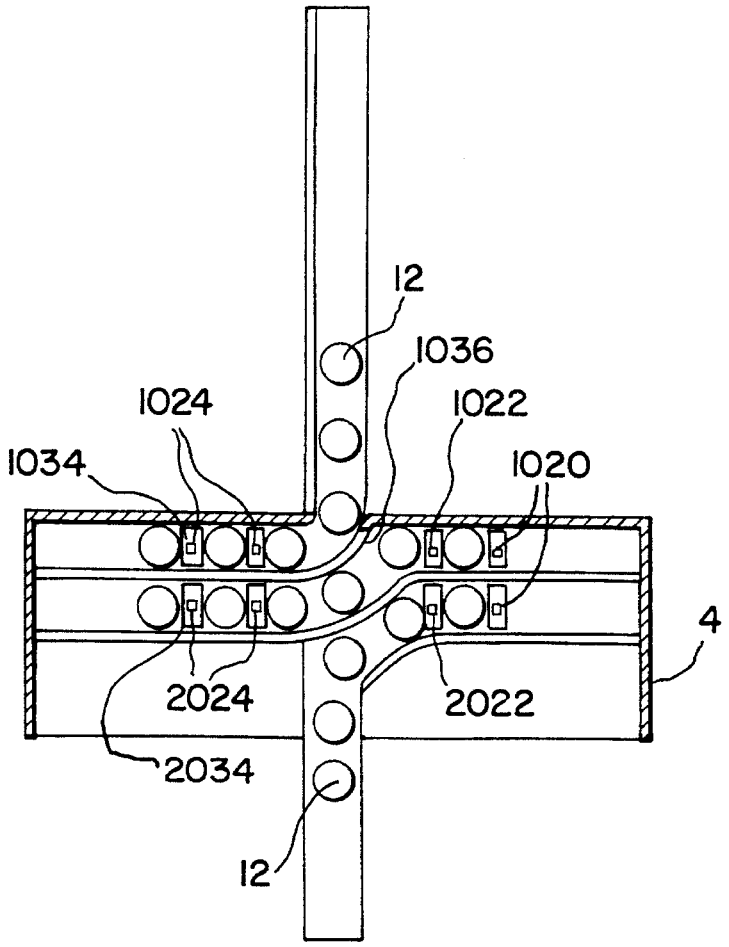
FIG. 7 is a plan view of a modified bottle filling machine in accordance with this invention, the rotary spoke assembly being omitted and upper portion of the drum cut away to illustrate the guide rails which direct the bottles in two separate orbits, a first orbit in which the bottles are washed and a second orbit in which they are filled.
Figure 8:
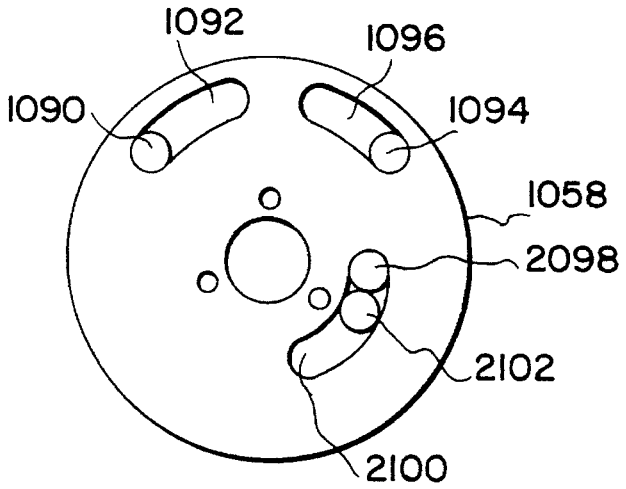
FIG. 8 is a plan view of the modified valve plate used in the modified bottle filling machine of FIG. 7.
Figure 9:
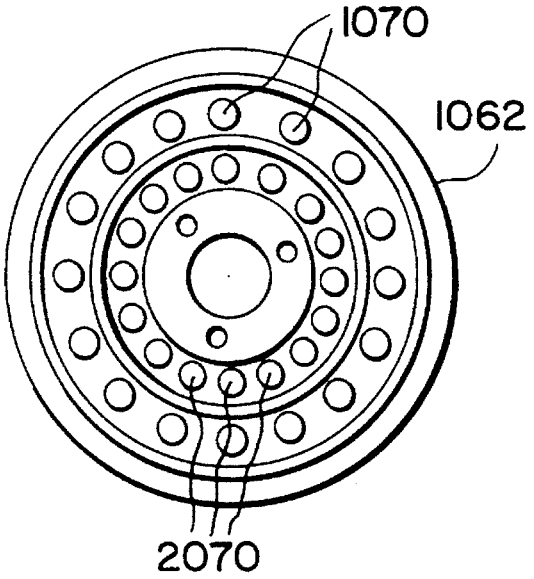
FIG. 9 is a plan view of the modified valve cup used in the modified bottle filling machine shown in FIG. 7 and also used in the second modified bottle filling machine shown in FIG. 11.
Figure 10:
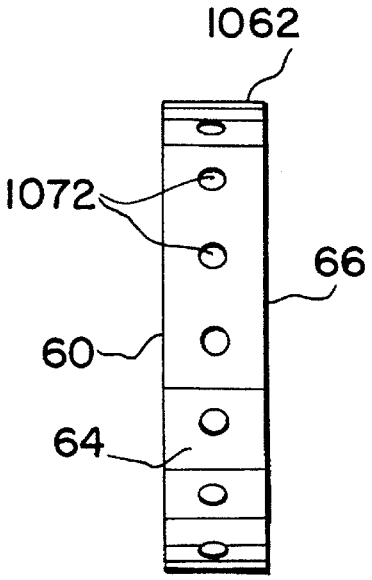
FIG. 10 is a side elevation view of the valve cup shown in FIG. 9.
Figure 11:
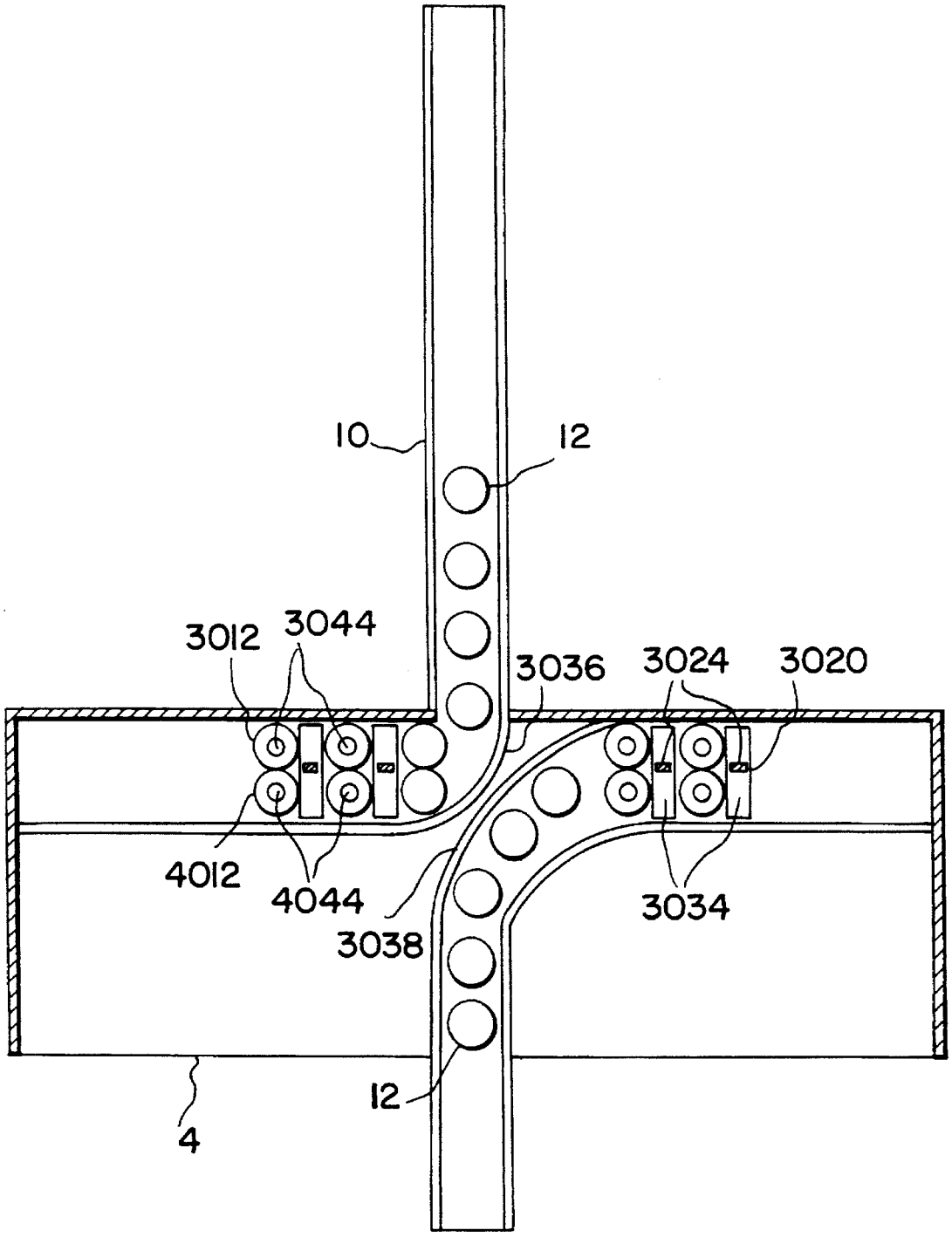
FIG. 11 is a plan view of a second modified bottle filling machine in accordance with this invention, the rotary spoke assembly being omitted and the upper portion of the cylindrical drum being cut away to illustrate the guide rails and rotational paths of two adjacent circular rows of bottles which are rinsed and filled during a single revolution.
Figure 12:
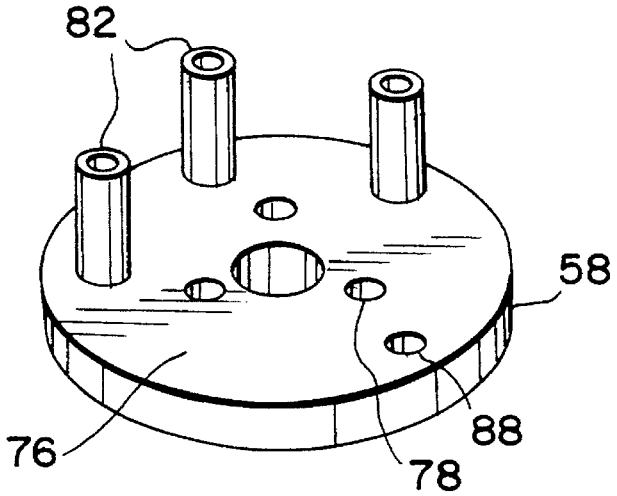
FIG. 12 is a perspective view of the rearwardly facing side of a valve plate for use in the bottle filling machine in accordance with this invention.
Figure 13:
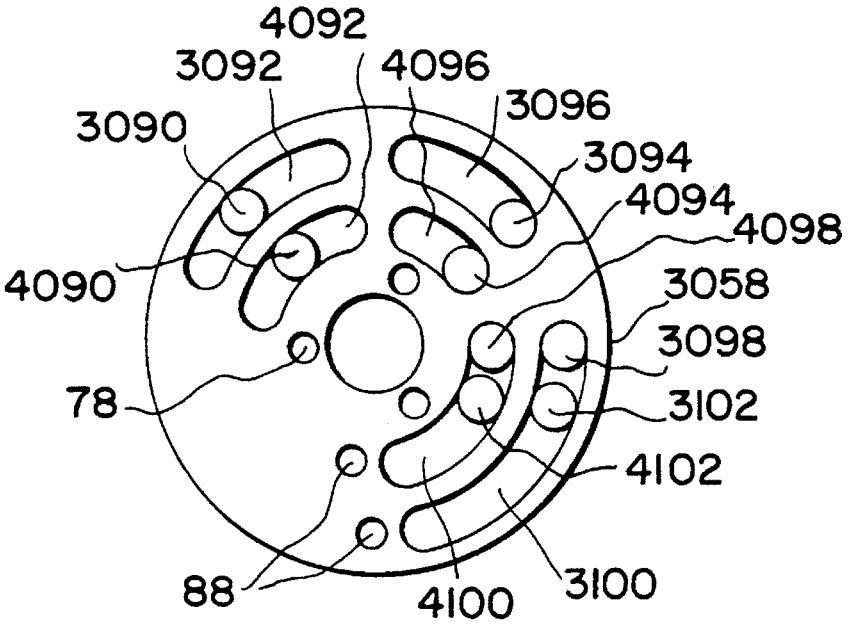
FIG. 13 is a plan view of the modified valve plate used in the second modified bottle filling machine shown in FIG. 11.

A bottle washing and filling machine in accordance with the present invention comprises a rotating spoke assembly 2 mounted for rotation within a cylindrical drum 4 supported vertically by a frame 6.

A through passageway 8 is provided through the lower portion of the cylindrical drum 4 at the six o'clock position. A conveyor line 10 extends through the passageway 8 on which bottles 12 are conveyed to the rotating spoke assembly 2, rotated therearound to washing, rinsing, drying and filling positions, and then when filled conveyed away from the washing and filling machine to the next processing station such as capping the bottles, applying labels and the like.

The cylindrical drum 4 comprises a large diameter cylindrical side wall 14 extending in a circular path vertically from each side of the through passageway at the lower or six o'clock position, a rear wall 16 facing in the upstream direction of the conveyor line 10, and an open front wall 18 facing in the downstream direction of the conveyor line 10.

The rotating spoke assembly 2 comprises an axle 20 which extends through a central aperture 22 of the rear wall 16 of the drum 4, connected by a drive assembly 24 on the upstream side of the rear wall 16 to an electric motor 26 for rotation thereof. A plurality of spokes 28 extend radially from the axle 20 on the downstream side of the rear wall 16 of the drum 4, within the operating cavity 30 of the drum 4 bounded by its rear wall 16 and cylindrical side wall 14. The spokes 28 terminate in outer free ends 32 at a pre-determined short distance radially inwardly from the cylindrical side wall 14.

Separator pads 34 of resilient, compressive, shock absorbent material are secured to the outer end region of the spokes 28, extending inwardly of the free ends 32 a distance that will place the separator pads 34 for contact with bottles 12 as they are carried on the conveyor line 10 into the rotational path of the vertically mounted rotating spoke assembly 2 between an adjacent pair of spokes 28 and their respective separator pads 34.

A guide rail 36 is mounted on the downstream side of the rear wall 16 adjacent the passageway 8 therethrough and along one side of the conveyor line 10 to contact and direct each bottle as it comes through the passageway 8 into the vertically extending rotational path of the spoke assembly 2, between an adjacent pair of spokes and their respective separator pads 34.

When viewing the vertical drum 4 and rotational spoke assembly 2 from the downstream side and looking in the upstream direction through the open front wall 18 of the drum 4, the spoke assembly 2 is seen to rotate in the clockwise direction.

An adjustable arcuate ramp 38 is provided around and adjacent to the inner surface 40 of the cylindrical side wall 14 of the drum 4, having radially extending adjusting screws 42 radially spaced apart and extending through the cylindrical side wall 14 with their inner ends connected to the arcuate ramp 38 and their outer ends outward of the cylindrical side wall 14 of the drum 4 for access to adjust the distance the ramp 38 is moved radially inward toward the center of the spoke assembly 2 and radially outward therefrom.

Bottle insert tubes 44 extend radially outward between each adjacent pair of spokes 28 from a rotary valve assembly 46 having free ends 48 which terminate within the frusto-conical cavities 50 of centering members 52 mounted between each adjacent pair of spokes 28. The frusto-conical cavities 50 open at their wide ends facing toward the arcuate ramp 38 and the open necks 54 of the bottles 12 carried between separator pads 34 along the ramp 38.

The arcuate ramp 38 is adjusted by adjusting screws to move it radially inwardly gradually as it extends clockwise, viewed from the front, from the six o'clock position toward the nine o'clock position, to a position wherein the bottles 12 sliding therealong are moved radially inwardly toward the center far enough for the outer ends of the bottle insert tubes 44 to enter the mouth of the bottles.

When the bottles 12 are rotated clockwise viewed from the front by the rotating spoke assembly 2, by the time they have reached the seven o'clock position the bottles have been moved inwardly enough for the insert tubes 44 to have entered the mouths of the bottles 12. They remain at that position radially spaced apart from the center with the insert tubes 44 in the bottles throughout the remainder of their revolution until just before returning to the six o'clock position for discharge on to the conveyor line 10 and movement downstream to the next work station or into a second arcuate path for a second orbit around the cylindrical drum 4.

During each revolution of the spoke assembly 2, the rotary valve assembly 46 flows a rinsing fluid such as water through the insert tubes 44 into the bottles 12 while they are rotated through that part of the arcuate path between a point about midway between the ten and eleven o'clock positions, viewed from the front and about midway between the eleven o'clock and twelve o'clock positions, or an arcuate distance of about thirty degrees.

From about midway between the eleven and twelve o'clock positions to about the two o'clock position, viewed from the front or an arcuate distance of about eighty five degrees, the valve assembly 46 discontinues the flow of washing fluid through the insert tubes 44 into the bottles 12. As the bottles are rotated through this portion of their revolution around the vertical cylindrical drum 4, they are substantially inverted whereupon the washing fluid drains out into a drain assembly 56.

Throughout that portion of the arcuate pathway wherein the bottles 12 are inverted and drain, the valve assembly 46 flows pressurized air through the insert tubes 44 and into the bottles 12 to dry them as they are drained.

When the spokes 28 and bottles 12 therebetween reach the three o'clock position rotating clockwise, viewed from the front and while they are rotating through the part of the arcuate path between the three o'clock position to about the five o'clock position, the valve assembly 46 flows a selected filling liquid such as a beverage through the insert tubes 44 into the bottles 12 until each is filled. Such flow of filling liquid through the insert tubes 44 is discontinued by the valve assembly 46 when they and the bottles 12 reach the five o'clock position viewed from the front. The filled bottles are then discharged on to the conveyor line 10 when they reach the six o'clock position and conveyed downstream to the next work station.

The rotary valve assembly 46 comprises a non-rotating or stationary circular plate 58 seated over the open entrance wall 60 of a corresponding cylindrical cup member 62 which is connected to and rotates with the rotating spoke assembly 2. The cup member 62 has a cylindrical side wall 64 and a bottom cup wall 66 having a central aperture 68 through which the axle 20 of the rotating spoke assembly extends.

Bolt receiving apertures 69 extend through the bottom cup wall 66 for securing the rotatable cup member 62 to the rotating spoke assembly 2.

Radially spaced apart discharge apertures 70 are provided through and around the bottom cup wall 66 adjacent its cylindrical side wall 64, in communication with radially extending outlet ducts 72 which open to the cylindrical side wall 64.

Each of the bottle insert tubes 44 is connected to respective ones of the outlet ducts 72 to receive fluid materials flowed into the cup member 62 of the valve assembly 46 and to flow such fluid materials therefrom into respective ones of the bottles 12 into which the bottle insert tubes 44 are received.

The non-rotating circular plate 58 of the rotary valve assembly 46 seats over the open entrance wall 60 of the cup member 62, within the cylindrical side wall 64 thereof, and abutting against the bottom wall 66 of the cup member 62. The outwardly facing surface 76 of the circular plate 58 is coplanar with the open entrance wall 60 of the valve cup 62 when seated in place on such cup member 62.

Bolt receiving apertures 78 extend through the circular plate 58 for securing the plate 58 to the rear wall 16 of the cylindrical drum 4. Compression springs on the bolts between the stationary plate 58 and rear wall 16 urge the valve plate into bearing engagement against the bottom wall 66 of the valve cup member 62. The stationary valve plate 58 is preferably made of stainless steel. The valve cup member is preferably made of high density polyethylene.

Inlet apertures 80 extend through the circular plate 58, having inlet ducts 82 connected thereto on the outwardly facing surface 76 of the plate 58. The inlet apertures 80 are radially spaced apart and positioned respectively for communication with discharge apertures 70 of the rotatable cup member 62 as they come into and pass through respective portions of the arcuate pathway during which each of the operations of the bottle washing and filling machine in accordance with this invention are performed.

Arcuately extending distribution grooves 84 are provided on the inwardly facing surface 86 of the circular plate 58, extending inwardly therefrom, each in communication with a respective one of the inlet apertures 80. The arcuate distribution grooves 84 are positioned to lie in the circular pathway of the discharge apertures 70 of the rotatable cup member 62, for registration with a plurality of such discharge apertures 70 as they pass from one end of each arcuate groove 84 to the other. Thus, fluid materials passing through the inlet apertures 80 flow into respective ones of the arcuate distribution grooves 84 and out through the respective plurality of discharge apertures 70 of the cup member 62 which are at the time in registration with such arcuate distribution groove 84, thence through outlet ducts 72 into the bottle insert tubes 44 connected thereto and into the bottles 12 in which the insert tubes 44 are received.

The inwardly facing surface 86 of the stationary circular plate 58 is in abutting and sealing relationship with the corresponding inwardly facing surface 88 of the bottom cup wall 66 when the plate 58 is seated thereon, whereby fluid material flowing from the arcuate distribution grooves 84 is able to flow only into discharge apertures 70 through the bottom cup wall 66 which are at the time in facing relationship with a one of the arcuate distribution grooves 84. An air relief aperture 88 is provided through the valve plate 58 a short distance from the end of the last arcuate distribution groove 84 viewed clockwise from the front to allow passage of air sufficient for the fluid supply tubes leading to the inlet apertures of the valve plate 58 to drain.

Inlet aperture 90 of stationary circular plate 58 is connected to a source of rinse water and is positioned permanently at a point about midway between the ten and eleven o'clock positions viewed from the front. Rinse water flows through inlet aperture 90 into its corresponding distribution groove 92 to enter and flow through discharge apertures 70 of the rotating cylindrical cup member 62 when they pass distribution groove 92 during their rotation around the drum 4. Rinse water flows from discharge aperture 70 through outlet ducts 72 and insert tubes 44 into the bottles 12 in which they are inserted. The distribution groove 92 extends in an arc from about the ten o'clock position viewed from the front to about midway between the eleven and twelve o'clock positions.

Inlet aperture 94 of stationary circular plate 58 is connected to a source of pressurized air and is positioned permanently at a point about midway between the one o'clock and two o'clock positions viewed from the front. Pressurized air flows through inlet aperture 94 into its corresponding distribution groove 96 to enter and flow through discharge apertures 70 of the rotating cylindrical cup member 62 when they pass distribution groove 96 during their rotation around the drum 4. Pressurized air flows from discharge apertures 70 through outlet ducts 72 and insert tubes 44 into the bottles 12 in which they are inserted to dry them prior to reaching the filling stage. The distribution groove 96 extends in an arc from a point about midway between the twelve o'clock and one o'clock position viewed from the front to about midway between the one o'clock and two o'clock positions.

Inlet aperture 98 of stationary circular plate 58 is connected to a distilled water supply tank or other supply tank of liquid material to fill the bottles 12. The inlet aperture 98 is positioned permanently at the three o'clock position viewed from the front. Such distilled water or other liquid material with which the bottles are to be filled is flowed through inlet aperture 98 into its corresponding distribution groove 100 to enter and flow through discharge apertures 70 of the rotating cylindrical cup member 62 when they pass the distribution groove 100 during their rotation around the drum 4. Filling material flows from discharge apertures 70 through outlet ducts 72 and insert tubes 44 into the bottles 12 in which they are inserted. The distribution groove 100 extends in an arc from the three o'clock position to the five o'clock position viewed from the front.

An additional inlet aperture 102 may be provided in the plate 58 opening to distribution groove 100, such aperture 102 also connected to a distilled water supply tank or other supply tank of liquid material to flow a greater volume of such liquid into the distribution groove 100 and into the insert tubes 44 for filling the bottles 12.

In a first modified form of the bottle washing and filling machine, the bottles 12 are rotated through two revolutions around the drum 4 by a modified dual spoke assembly 1020. The dual spoke assembly 1020 includes a first spoke assembly 1022 comprising a plurality of spokes 1024 extending radially from the axle 20 adjacent the downstream side of the rear wall 16 of the drum 4, with separator pads 1034 secured to the free ends of the spokes 1024. The dual spoke assembly 1020 also includes a second spoke assembly 2022 comprising a plurality of spokes 2024 extending radially from the axle 20 adjacent to the first spoke assembly 1022 and on the downstream side thereof, the second spoke assembly 2022 having separator pads 2034 secured to the free ends of its spokes 2024.

In this modified form of the bottle washing and filling machine, each bottle 12 is rotated through two complete revolutions, first carried around the spoke assembly 1022 of the modified dual spoke assembly 1020 wherein each bottle 12 is washed and rinsed with a detergent and then diverted by guide rail 1036 at the six o'clock position viewed from the front, into the path of the second spoke assembly 2022 for a second revolution around the drum 4 wherein each bottle 12 is filled with a liquid material such as distilled water.

The modified circular valve plate 1058 of this modified form of the invention includes a first inlet aperture 1090 connected to a source of rinse water and is positioned permanently at a point about midway between the ten and eleven o'clock positions viewed from the front, in an outer circular pathway extending around the modified circular valve plate 1058. Rinse water flows through inlet aperture 1090 into its corresponding arcuate distribution groove 1092 to enter and flow through discharge apertures 1070 in an outer circular pathway around a modified rotating cylindrical cup member 1062 when such apertures 1070 pass across the distribution groove 1092 during their rotation around the drum 4. Such rinse water then flows from discharge aperture 1070 through outlet ducts 1072 and corresponding insert tubes into the bottles 12 as they are being rotated by the first spoke assembly 1022 during their first rotation around the drum 4. The distribution groove 1092 extends in an arc in the outer circular pathway from about the ten o'clock position viewed from the front to about midway between the eleven and twelve o'clock positions.

The modified circular valve plate 1058 includes a second inlet aperture 1094 in the outer circular pathway, located therein at a point about midway between the one o'clock and two o'clock positions viewed from the front. Pressurized air flows from a source through an air hose connected to aperture 1094, through such aperture and into its corresponding arcuate distribution groove 1096 to enter and flow through outlet apertures 1070 in an outer circular path around the modified rotating cylindrical cup member 1062 as they pass across the distribution groove 1096. Such pressurized air then flows into corresponding insert tubes connected to the outlet ducts 1072 and thence into the bottles 12 during their first rotation around the drum 4. The distribution groove 1096 in an arc in the outer circular pathway from a point about midway between the twelve o'clock and one o'clock positions viewed from the front to about midway between the one o'clock and two o'clock positions.

The modified circular valve plate 1058 includes third and fourth inlet apertures 2098 and 2102 which are located in a second circular pathway around the modified valve plate 1058. Inlet aperture 2098 is located at the three o'clock position viewed from the front, and inlet aperture 2102 is located adjacent thereto on the side toward the four o'clock position viewed from the front. Inlet apertures 2098 and 2102 are connected to a distilled water supply tank or other supply tank of liquid material to fill the bottles 12, which liquid flows through inlet apertures 2098 and 2102 into their corresponding arcuate groove 2100 located in the second circular pathway around the modified valve plate 1058, which is radially inward from the first circular pathway. The distribution groove 2100 extends in an arc in the radially inward second circular pathway from the three o'clock position to the five o'clock position viewed from the front.

The modified rotating cylindrical cup member 1062 includes an inner ring of spaced apart outlet apertures 2070 which extend through modified cup member 1062, from its rearwardly or upstream facing wall to its forwardly or downstream facing wall, to which insert tubes are connected for insertion into the bottles 12 when they have been diverted by guide rail 1036 into the rotational pathway of the second spoke assembly 2022.

The radially spaced apart outlet apertures 2070 in the inner ring are radially inward from the radially spaced apart outlet apertures 1070. The inner ring outlet apertures 2070 come into registration with inlet apertures 2098 and 2102 and their arcuate distribution groove 2100 as they are rotated through that part of the circular pathway between the three o'clock and five o'clock positions. The liquid filling material flows into the bottles 12 throughout that part of their travel between the spokes 2024 of the second spoke assembly 2022.

Two spoke assemblies 1022 and 2022, have been described for convenience to more clearly indicate that the same bottles 12 are rotated twice around the drum 4 in two separate but adjacent rotational pathways. A single spoke assembly 1022 can perform the same function, having a single set of spokes 1024 with a single set of separator pads 1034 at their free ends, in which case the separator pad 1034 are wide enough to span across both of the rotational pathways to move the bottles both while in the upstream rotational path and after being guided into the downstream rotational path by the guide rail 1036 upon completion of their rotation in the upstream rotational path.

In a second modified form of the bottle washing and filling machine two circular rows of bottles 12 are rotated simultaneously in side by side, upstream-downstream, relationship by a modified single spoke assembly 3020, comprising a plurality of spokes 3024 extending radially from the axle 20 with separator pads 3034 secured to the free end of the spokes 3024.

The separator pads 3034 have an upstream-downstream dimension great enough to extend into both rotational pathways of both circular rows of bottles, each adjacent to the other, one on the upstream side and one on the downstream side, and for each separator pad 3034 to propel two bottles, one on the upstream side, one on the downstream side, throughout each rotation around the drum 4.

A guide rail 3036 at the six o'clock position guides two bottles at a time from the conveyor line 10 into the rotational pathway of the spoke assembly 3020 and in front of a single one of the separator pads 3034, the first bottle 12 on the conveyor line 10 being guided to the downstream side of the separator pad 3034 and the next bottle in line being guided to the upstream side thereof. Bottles 3012 are between the spokes and separator pads 3034 in the rotational pathway on the upstream side and bottle 4012 are therebetween in the rotational pathway on the downstream side.

When each rotation is completed, a discharge guide rail 3038 at this six o'clock position guides the bottles out of the rotational pathway of the spoke assembly 3020 and back on to the conveyor line 10.

In the second modified form of the bottle washing and filling machine, the bottles in both of the circular rows are rinsed and filled during a single revolution around the drum 4.

In this modification, the rotating cylindrical cup member 1062 is the same as in the first modification having two concentric circular rows of apertures, including an outer circular row of radially spaced apart outlet apertures 1070 and an inner circular row of radially spaced apart outlet apertures 2070.

The stationary valve plate member 3058 in this second modification includes a first rinse inlet aperture 3090 connected to a source of rinse water and is positioned when connected to the back wall of the drum 4 and viewed from the front at a point about midway between the ten and eleven o'clock positions, in an outer circular pathway extending around the modified valve plate 3058. Rinse water flows through the discharge apertures 1070 of the cylindrical cup member 1062 when they rotate past the arcuate distribution groove 3092 to which inlet aperture 3090 opens, from discharge apertures 1070 through outlet ducts 1072 into insert tubes 3044 and bottles 3012 in the upstream side rotational pathway.

The valve plate member 3058 in this second modification includes a second rinse inlet aperture 4090 also connected to a source of rinse water, spaced apart radially inwardly of the first rinse inlet aperture 3090 and also positioned at a point about midway between the ten and eleven o'clock positions viewed from the front, in an inner circular pathway extending around modified valve plate 3058. Rinse water flows from the second rinse inlet aperture 4090 through discharge apertures 2070 in the inner ring of outlet or discharge apertures of the modified rotating cylindrical cup member 1062 as they rotate past the arcuate distribution groove 4092 to which the second rinse inlet aperture 4090 opens, through insert tubes 4044 connected to respective ones of the discharge apertures 2070 in the inner ring of apertures through the modified rotating cylindrical cup member 1062, and thence into bottles 4012 in the rotational pathway on the downstream side.

The distribution grooves 3092 in the outer circular pathway and 4092 in the inner circular pathway around the modified valve plate 3058 extend in an arc from about the ten o'clock position viewed from the front to about midway between the eleven and twelve o'clock positions.

The modified valve plate 3058 includes a first pressurized air inlet aperture 3094 in the outer circular pathway and a second pressurized air inlet aperture 4094 radially inwardly from aperture 3094 and in the inner circular pathway around the modified valve plate 3058. The first pressurized air inlet aperture 3094 opens to an arcuate distribution groove 3096 in the outer circular pathway and the second pressurized air inlet aperture 4094 opens to an arcuate distribution groove 4096 in the inner circular pathway.

The discharge apertures 1070 in the outer ring of the modified cup member 1062 rotate past the first pressurized air inlet aperture 3094 and its corresponding distribution groove 3096, while the discharge apertures 2070 in the inner ring of the modified cup member 1062 rotate past the second pressurized air inlet aperture 4094 and its corresponding distribution groove 4096.

The insert tubes 3044 connected to discharge aperture 1070 through outlet ducts 1072 flow pressurized air through insert tubes 3044 and into bottles 3012 in the rotational pathway on the upstream side as apertures 1070 rotate past distribution groove 3096. The insert tubes 4044 connected to discharge apertures 2070 flow pressurized air through insert tubes 4044 and into bottles 4012 in the rotational pathway on the downstream side as apertures 2070 rotate past distribution groove 4096.

The arcuate distribution grooves 3096 in the outer circular pathway and 4096 in the inner circular pathway around the modified valve plate 3058 extend in an arc from a point about midway between the twelve o'clock and one o'clock positions viewed from the front to about midway between the one o'clock and two o'clock positions.

The modified valve plate 3058 includes first fill inlet apertures 3098 and 3102 in the outer circular pathway and second fill inlet apertures 4098 and 4102 in the inner circular pathway around the modified valve plate 3058, spaced apart radially inward from apertures 3098 and 3102 respectively. The first fill inlet apertures 3098 and 3102 open to an arcuate distribution groove 3100 in the outer circular pathway and the second fill inlet apertures 4098 and 4102 open to an arcuate distribution groove 4100 in the inner circular pathway.

The discharge apertures 1070 in the outer ring of the modified cup ring 1062 rotate past the first fill apertures 3098 and 3102 and their corresponding distribution groove 3100, while the discharge aperture 2070 in the inner ring of the modified cup member 1062 rotate past the second fill apertures 4098 and 4102 and their corresponding distribution grooves 4100.

The insert tubes 3044 connected to the discharge apertures 1070 through outlet ducts 1072 flow filling material such as distilled water through insert tube 3044 and into bottles 3012 in the rotational pathway on the upstream side as apertures 1070 rotate past distribution groove 3100. The insert tubes 4044 connected to discharge apertures 2070 flow filling material such as distilled water through insert tube 4044 and into bottles 4012 in the rotational pathway on the downstream side as apertures 2070 rotate past distribution groove 4100.

The arcuate distribution grooves 3100 in the outer circular pathway and 4100 in the inner circular pathway around the modified valve plate 3058 extend in an arc from the three o'clock position viewed from the front to the five o'clock position.

Thus, in the second modified bottle washing and filling machine, as the bottles 3012 are rotated around the upstream rotational pathway and the adjacent bottles 4012 are rotated around the adjacent downstream rotational pathway, rinse water is flowed into the bottles 3012 and 4012 between about the ten o'clock position viewed from the front to about midway between the eleven and twelve o'clock positions, pressurized air is flowed into the bottles 3012 and 4012 as they rotate from a point about midway between the twelve o'clock and one o'clock positions viewed from the front to about midway between the one o'clock and two o'clock positions, and the bottles 3012 and 4012 are filled with distilled water or other filling material as they are rotated from the three o'clock to the five o'clock position.

The filled bottles are then directed back on to the conveyor line 10 when they are rotated back to the six o'clock position.

We claim:

1. A bottle filling machine comprising a rotatable assembly having a central axis and rotatable thereon, said rotatable assembly having entrance means positioned to receive bottles from the upstream side of a conveyor, discharge means to discharge said bottles to the downstream side of a said conveyor, power means to rotate said rotatable assembly on said central axis through a rotational pathway, rotational drive and support means to continuously move said bottles around said rotational pathway supported with their longitudinal axis radially directed toward said central axis of said rotatable assembly and their entrance apertures facing toward said central axis, said rotational pathway having a bottle inverted portion between the nine o'clock and three o'clock positions moving clockwise from the nine o'clock to three o'clock position, a bottle filling portion between the three o'clock and nine o'clock positions moving clockwise from the three o'clock to nine o'clock position, and filling means to fill said bottles with a selected fluid material only while being continuously moved through at least a part of said bottle filling portion of said rotational pathway, said filling means including fluid conduit means to flow fluid into said bottles while they are being rotated.

2. A bottle filling machine as set forth in claim 1, wherein said filling means includes a valve assembly, said valve assembly includes a first inlet port connected to a supply of selected fluid material with which said bottles are to be filled, outlet port means for discharging a portion of said selected fluid material to each of said bottles while being continuously moved through at least a part of said bottle filling portion of said rotational pathway, said fluid conduit means being connected between said outlet port means and each one of said bottles to continuously rotate with said bottles and carry respective portions of said selected fluid material to fill respective ones of said bottles while they are being rotated.

3. A bottle filling machine as set forth in claim 2, wherein said valve assembly includes a valve plate, said first inlet port extending through said valve plate, said outlet port means includes a rotatable valve member connected to continuously rotate with said rotatable assembly, said rotatable valve member having a rotatable wall with a bearing surface to face and bear against said valve plate and an oppositely facing surface, a plurality of first discharge apertures extending through said rotatable valve member opening inwardly to said bearing surface of said rotatable wall and spaced apart radially around said rotatable wall in a first circular pathway therearound, said first inlet port through said valve plate being positioned to face said first circular pathway and for registration with each one of said first discharge apertures as they are rotated in said first circular pathway with said rotatable valve member and said rotatable assembly.

4. A bottle filling machine as set forth in claim 3, wherein said valve plate includes a bearing surface to face and bear against said bearing surface of said rotatable valve member, said valve plate being secured in a fixed position on said bottle filling machine coaxially with said central axis of said rotatable assembly and with said rotational pathway in which said rotatable assembly is rotated, said first inlet aperture being located radially in line with said three o'clock position of said rotational pathway to feed selected fluid filling material to and through said first discharge apertures in said first circular pathway of said rotatable valve member for feeding into said bottles as they are continuously rotated past the said three o'clock position moving clockwise.

5. A bottle filling machine as set forth in claim 4, wherein said bearing surface of said valve plate includes a first arcuate distribution groove opening to face said bearing surface of said rotatable wall of said rotatable valve member and extending arcuately in an arcuate pathway corresponding to that of said first circular pathway and first discharge apertures therein of the said rotatable valve member, a first end of said first arcuate distribution groove being located radially in line with said three o'clock position of said rotational pathway, the opposite end of said first arcuate distribution groove being located radially in line with the five o'clock position of said rotational pathway moving clockwise, said first inlet aperture opening to said first arcuate distribution groove at its said first end, selected fluid filling material passing into said first distribution groove for discharge through the plurality of said first discharge apertures which come into registration with said first distribution groove as they are rotated past and for feeding fluid, while continuing to rotate, into said bottles to which said first discharge apertures are connected through said fluid conduit means.

6. A bottle filling machine as set forth in claim 5, wherein said valve plate includes a second inlet port opening to its said bearing surface, said second inlet port being connected to a supply of rinse water, said second inlet port being located radially in line with a position between the nine and three o'clock positions of said rotational pathway moving clockwise from the nine o'clock to three o'clock positions and opening to face said first circular pathway around said rotatable wall of said rotatable valve member and to said first discharge apertures spaced apart radially therein, a second arcuate distribution groove opening to face said bearing surface of said rotatable wall of said rotatable valve member and extending arcuately in an arcuate pathway corresponding to that of said first circular pathway and first discharge apertures therein of the said rotatable valve member, said second inlet aperture opening to said second arcuate distribution groove, rinse water passing into said second arcuate distribution groove for discharge through the plurality of said first discharge apertures which come into registration with said second distribution groove as they are rotated past and for flowing, while being rotated, rinse water into said bottles to which said first discharge apertures are connected through said fluid conduit means.

7. A bottle filling machine as set forth in claim 6, wherein said valve plate includes a third inlet port opening to its said bearing surface, said third inlet port being connected to a source of pressurized air, said third inlet port being located radially in line with a position between the said second inlet port and the three o'clock position of said rotational pathway moving clockwise from the nine o'clock to three o'clock position and opening to face said first circular pathway around said rotatable wall of said rotatable valve member and to said first discharge apertures spaced apart radially therein, a third arcuate distribution groove opening to face said bearing surface of said rotatable wall of said rotatable valve member and extending arcuately in an arcuate pathway corresponding to that of said first circular pathway and first discharge apertures therein of the said rotatable valve member, said third inlet aperture opening to said third arcuate distribution groove, pressurized air passing into said third arcuate distribution groove for discharge through the plurality of said first discharge apertures which come into registration with said third arcuate distribution groove as they are rotated past and for flowing, while being rotated, pressurized air into said bottles to which said first discharge apertures are connected through said fluid conduit means.

8. A bottle filling machine as set forth in claim 5, wherein said valve plate includes a second inlet port opening to its said bearing surface, said second inlet port being connected to a supply of rinse water, said second inlet port being located radially in line with a position about midway between the ten and eleven o'clock positions of said rotational pathway moving clockwise and opening to face said first circular pathway around said rotatable wall of said rotatable valve member and to said first discharge apertures spaced apart radially therein, a second arcuate distribution groove opening to face said bearing surface of said rotatable wall of said rotatable valve member and extending arcuately in an arcuate pathway corresponding to that of said first circular pathway and first discharge apertures therein of the said rotatable valve member, a first end of said second arcuate distribution groove being located radially in line with said position about midway between the ten and eleven o'clock positions of said rotational pathway moving clockwise, the opposite end of said second arcuate distribution groove being located radially in line with a position about midway between the eleven and twelve o'clock positions of said rotational pathway moving clockwise, said second inlet aperture opening to said second arcuate distribution groove at its said first end, rinse water passing into said second arcuate distribution groove for discharge through the plurality of said first discharge apertures which come into registration with said second distribution groove as they are rotated past and for flowing rinse water, while continuing to rotate, into said bottles to which said first discharge apertures are connected through said fluid conduit means.

9. A bottle filling machine as set forth in claim 8, wherein said valve plate includes a third inlet port opening to its said bearing surface, said third inlet port being connected to a source of pressurized air, said third inlet port being located radially in line with a position about midway between the one and two o'clock positions of said rotational pathway moving clockwise and opening to face said first circular pathway around said rotatable wall of said rotatable valve member and to said first discharge apertures spaced apart radially therein, a third arcuate distribution groove opening to face said bearing surface of said rotatable wall of said rotatable valve member and extending arcuately in an arcuate pathway corresponding to that of said first circular pathway and first discharge apertures therein of the said rotatable valve member, a first end of said third arcuate distribution groove being located radially in line with a position about midway between the twelve and one o'clock positions of said rotational pathway moving clockwise, the opposite end of said third arcuate distribution groove being located radially in line with a position about midway between the one o'clock and two o'clock positions of said rotational pathway moving clockwise, said third inlet aperture opening to said third arcuate distribution groove at its said opposite end, pressurized air passing into said third arcuate distribution groove for discharge through the plurality of said first discharge apertures which come into registration with said third arcuate distribution groove as they are rotated past and for flowing pressurized air, while continuing to rotate, into said bottles to which said first discharge apertures are connected through said conduit means.

10. A bottle filling machine as set forth in claim 2, wherein said rotatable assembly rotates each bottle around two orbits before discharge, including a first orbit in which bottles may be washed and rinsed and a second orbit in which bottles may be filled, washing means to wash said bottles and rinsing means to rinse said bottles while being rotated in said first orbit, said rotatable assembly including orbit transfer means to transfer said bottles from said first orbit after completion thereof into said second orbit, wherein said valve assembly includes a valve plate, said first inlet port extending through said valve plate, said outlet port means includes a rotatable valve member connected to rotate with said rotatable assembly, said rotatable valve member having a rotatable wall with a bearing surface to face and bear against said valve plate and an oppositely facing surface, a plurality of first discharge apertures extending through said rotatable valve member, opening inwardly to said bearing surface of said rotatable wall, and spaced apart radially around said rotatable wall in a first circular pathway therearound, a plurality of second discharge apertures extending through said rotatable valve member opening inwardly to said bearing surface of said rotatable wall and spaced apart radially around said rotatable wall in a second circular pathway which is concentric with said first circular pathway and radially inwardly thereof, said first inlet port through said valve plate being positioned to face said second circular pathway and for registration with each one of said second discharge apertures as they are rotated in said second circular pathway with said rotatable valve member and said rotatable assembly.

11. A bottle filling machine as set forth in claim 10, wherein said valve plate includes a bearing surface to face and bear against said bearing surface of said rotatable valve member, said valve plate being secured in a fixed position on said bottle filling machine coaxially with said central axis of said rotatable assembly and with said rotational pathway in which said rotatable assembly is rotated, said first inlet aperture being located radially in line with said three o'clock position of said rotational pathway to feed selected fluid filling material to and through said second discharge apertures in said second circular pathway of said rotatable valve member for feeding into said bottles in said second orbit as they are rotated past the said three o'clock position moving clockwise, said fluid conduit means of said filling means including first orbit fluid conduit means connected between said first discharge apertures and said bottles in said first orbit, and second fluid orbit conduit means connected between said second discharge apertures and said bottles in said second orbit.

12. A bottle filling machine as set forth in claim 11, wherein said bearing surface of said valve plate includes a first arcuate distribution groove opening to face said bearing surface of said rotatable wall of said rotatable valve member and extending arcuately in an arcuate pathway corresponding to that of said second circular pathway and second discharge apertures therein of the said rotatable valve member, a first end of said first arcuate distribution groove being located radially in line with said three o'clock position of said rotational pathway, the opposite end of said first arcuate distribution groove being located radially in line with the five o'clock position of said rotational pathway moving clockwise, said first inlet aperture opening to said first arcuate distribution groove at its said first end, selected fluid filling material passing into said first distribution groove for discharge through the plurality of said second discharge apertures which come into registration with said first arcuate distribution groove as they are rotated past and for feeding into said bottles while they are being rotated in said second orbit to which said second discharge apertures are connected through said second orbit conduit means.

13. A bottle filling machine as set forth in claim 12, wherein said valve plate includes a second inlet port opening to its said bearing surface, said second inlet port being connected to a supply of rinse water, said second inlet port being located radially in line with a position between the nine and three o'clock positions of said rotational pathway moving clockwise from the nine o'clock to the three o'clock position and opening to face said first circular pathway around said rotatable wall of said rotatable valve member and to said first discharge apertures spaced apart radially therein, a second arcuate distribution groove opening to face said bearing surface of said rotatable wall of said rotatable valve member and extending arcuately in an arcuate pathway corresponding to that of said first circular pathway and first discharge apertures therein of the said rotatable valve member, said second inlet port opening to said second arcuate distribution groove, rinse water passing into said second arcuate distribution groove for discharge through the plurality of said first discharge apertures which come into registration with said second distribution groove as they are rotated past and for flowing, while being rotated, rinse water into said bottles in said first orbit to which said first discharge apertures are connected through said first orbit fluid conduit means.

14. A bottle filling machine as set forth in claim 13, wherein said valve plate includes a third inlet port opening to its said bearing surface, said third inlet port being connected to a source of pressurized air, said third inlet port being located radially in line with a position between the said second inlet port and the three o'clock position of said rotational pathway moving clockwise and opening to face said first circular pathway around said rotatable wall of said rotatable valve member and to said first discharge apertures spaced apart radially therein, a third arcuate distribution groove opening to face said bearing surface of said rotatable wall of said rotatable valve member and extending arcuately in an arcuate pathway corresponding to that of said first circular pathway and first discharge apertures therein of the said rotatable valve member, said third inlet aperture opening to said third arcuate distribution groove, pressurized air passing into said third arcuate distribution groove for discharge through the plurality of said first discharge apertures which come into registration with said third arcuate distribution groove as they are rotated past and for flowing, while being rotated, pressurized air into said bottles in said first orbit to which said first discharge apertures are connected through said first orbit fluid conduit means.

15. A bottle filling machine as set forth in claim 12, wherein said valve plate includes a second inlet port opening to its said bearing surface, said second inlet port being connected to a supply of rinse water, said second inlet port being located radially in line with a position about midway between the ten and eleven o'clock positions of said rotational pathway moving clockwise and opening to face said first circular pathway around said rotatable wall of said rotatable valve member and to said first discharge apertures spaced apart radially therein, a second arcuate distribution groove opening to face said bearing surface of said rotatable wall of said rotatable valve member and extending arcuately in an arcuate pathway corresponding to that of said first circular pathway and first discharge apertures therein of the said rotatable valve member, a first end of said second arcuate distribution groove being located radially in line with said position about midway between the ten and eleven o'clock positions of said rotational pathway moving clockwise, the opposite end of said second arcuate distribution groove being located radially in line with a position about midway between the eleven and twelve o'clock positions of said rotational pathway moving clockwise, said second inlet port opening to said second arcuate distribution groove at its said first end, rinse water passing into said second arcuate distribution groove for discharge through the plurality of said first discharge apertures which come into registration with said second distribution groove as they are rotated past and for flowing rinse water, while continuing to rotate, into said bottles in said first orbit to which said first discharge apertures are connected through said first orbit fluid conduit means.

16. A bottle filling machine as set forth in claim 15, wherein said valve plate includes a third inlet port opening to its said bearing surface, said third inlet port being connected to a source of pressurized air, said third inlet port being located radially in line with a position about midway between the one and two o'clock positions of said rotational pathway moving clockwise and opening to face said first circular pathway around said rotatable wall of said rotatable valve member and to said first discharge apertures spaced apart radially therein, a third arcuate distribution groove opening to face said bearing surface of said rotatable wall of said rotatable valve member and extending arcuately in an arcuate pathway corresponding to that of said first circular pathway and first discharge apertures therein of the said rotatable valve member, a first end of said third arcuate distribution groove being located radially in line with a position about midway between the twelve and one o'clock positions of said rotational pathway moving clockwise, the opposite end of said third arcuate distribution groove being located radially in line with a position about midway between the one o'clock and two o'clock positions of said rotational pathway moving clockwise, said third inlet aperture opening to said third arcuate distribution groove at its said opposite end, pressurized air passing into said third arcuate distribution groove for discharge through the plurality of said first discharge apertures which come into registration with said third arcuate distribution groove as they are rotated past and for flowing pressurized air, while continuing to rotate, into said bottles in said first orbit to which said first discharge apertures are connected through said first orbit conduit means.

17. A bottle filling machine as set forth in claim 2, wherein said rotatable assembly rotates sets of two side-by-side bottles at a time around a single orbit before discharge in an upstream circular row of bottles and an adjacent downstream circular row of bottles, during which the bottles in both the upstream and downstream circular row may be rinsed, aired and filled in said single orbit, rinsing means to rinse said bottles, aerating means to air said bottles, and fluid means to fill said bottles with fluid, said fluid filling means including said valve assembly, said first inlet port, and said outlet port means, wherein said valve assembly includes a valve plate, said first inlet port extending through said valve plate, said outlet port means includes a rotatable valve member connected to rotate with said rotatable assembly, said rotatable valve member having a rotatable wall with a bearing surface to face and bear against said valve plate and an oppositely facing surface, a plurality of first discharge apertures extending through said rotatable valve member, opening inwardly to said bearing surface of said rotatable wall, and spaced apart radially around said rotatable wall in a first circular pathway therearound, a plurality of second discharge apertures extending through said rotatable valve member, opening inwardly to said bearing surface of said rotatable wall, and spaced apart radially around said rotatable wall in a second circular pathway which is concentric with said first circular pathway and radially inwardly thereof, said first inlet port through said valve plate being positioned to face said first circular pathway and for registration with each one of said first discharge apertures as they are rotated in said first circular pathway with said rotatable valve member and said rotatable assembly, including a second inlet port through said valve plate being positioned radially inwardly from said first inlet port to face said second circular pathway and for registration with each one of said second discharge apertures as they are rotated in said second circular pathway with said rotatable valve member and said rotatable assembly, said second inlet port being also connected to a supply of selected fluid material with which said bottles are to be filled while they are being rotated.

18. A bottle filling machine as set forth in claim 17, wherein said valve plate includes a bearing surface to face and bear against said bearing surface of said rotatable valve member, said valve plate being secured in a fixed position on said bottle washing machine coaxially with said central axis of said rotatable assembly and with said rotational pathway in which said rotatable assembly is rotated, said first inlet aperture being located radially in line with said three o'clock position of said rotational pathway to feed selected fluid filling material to and through said first discharge apertures in said first circular pathway of said rotatable valve member for feeding into said bottles in said upstream circular row as they are continuously rotated past the said three o'clock position moving clockwise, said second inlet aperture being located radially inwardly from said first inlet aperture and radially in line with said three o'clock position of said rotational pathway to feed selected fluid filling material to and through said second discharge apertures in said second circular pathway of said rotatable valve member for feeding into said bottles in said downstream circular row as they are continuously rotated past the said three o'clock position moving clockwise, including upstream circular row fluid conduit means connected between said first discharge apertures and said bottles in said upstream circular row and downstream circular row fluid conduit means connected between said second discharge apertures and said bottles in said downstream circular row for filling said bottles with fluid while they are being rotated.

19. A bottle filling machine as set forth in claim 18, wherein said bearing surface of said valve plate includes a first arcuate distribution groove opening to face said bearing surface of said rotatable wall of said rotatable valve member and extending arcuately in an arcuate pathway corresponding to that of said first circular pathway and first discharge apertures therein of the said rotatable valve member, a first end of said first arcuate distribution groove being located radially in line with said three o'clock position of said rotational pathway, the opposite end of said first arcuate distribution groove being located radially in line with the five o'clock position of said rotational pathway moving clockwise, said first inlet aperture opening to said first arcuate distribution groove at its said first end, selected fluid filling material passing into said first distribution groove for discharge through the plurality of first discharge apertures which come into registration with said first arcuate distribution groove as they are rotated past and for feeding said fluid into said bottles in said upstream circular row to which said first discharge apertures are connected through said upstream circular row fluid conduit means, a second arcuate distribution groove opening to face said bearing surface of said rotatable wall of said rotatable valve member, said second arcuate distribution groove being located radially inwardly of said first arcuate distribution groove and extending arcuately in an arcuate pathway corresponding to that of said second circular pathway and second discharge apertures therein of the said rotatable valve member, a first end of said second arcuate distribution groove being located radially in line with said three o'clock position of said rotational pathway, the opposite end of said second arcuate distribution groove being located radially in line with the five o'clock position of said rotational pathway moving clockwise, said second inlet aperture opening to said second arcuate distribution groove at its said first end, selected fluid filling material passing into said second arcuate distribution groove for discharge through the plurality of second discharge apertures which come into registration with said second arcuate distribution groove as they are rotated past and for feeding said fluid into said bottles in said downstream circular row to which said second discharge apertures are connected through said downstream circular row fluid conduit means, for filling said bottles in both said upstream and downstream circular rows with said fluid while said bottles are being rotated.

20. A bottle filling machine as set forth in claim 19, wherein said valve plate includes a first rinse inlet port opening to its said bearing surface, said first rinse inlet port being connected to a supply of rinse water, said first rinse inlet port being located radially in line with a position between the nine and three o'clock positions of said rotational pathway moving clockwise from the nine o'clock to three o'clock position and opening to face said first circular pathway around said rotatable wall of said rotatable valve member and to said first discharge apertures spaced apart radially therein, a first rinse arcuate distribution groove opening to face said bearing surface of said rotatable wall of said rotatable valve member and extending arcuately in an arcuate pathway corresponding to that of said first circular pathway and first discharge apertures therein of the said rotatable valve member, said first rinse inlet port opening to said first rinse arcuate distribution groove, rinse water passing into said first rinse arcuate distribution groove for discharge through the plurality of said first discharge apertures which come into registration with said first rinse arcuate distribution groove as they are rotated past and for flowing, while being rotated, rinse water into said bottles in said upstream circular row to which said first discharge apertures are connected through said upstream circular row fluid conduit means, a second rinse inlet port through said valve plate opening to its said bearing surface and connected to a supply of rinse water, said second rinse inlet port being radially inward from said first rinse inlet port, said second rinse inlet port being located radially in line with a position between the said nine and three o'clock position of said rotational pathway moving clockwise from the nine o'clock to three o'clock position and opening to face said second circular pathway around said rotatable wall of said rotatable valve member and to said second discharge apertures spaced apart radially therein, a second rinse arcuate distribution groove opening to face said bearing surface of said rotatable wall of said rotatable valve member and extending arcuately in an arcuate pathway corresponding to that of said second circular pathway and second discharge apertures therein of said rotatable valve member, said second rinse inlet port opening to said second rinse arcuate distribution groove, rinse water passing into said second rinse arcuate distribution groove for discharge through the plurality of said second discharge apertures which come into registration with said second rinse arcuate distribution groove as they are rotated past and for flowing, while being rotated, rinse water into said bottles in said downstream circular row to which said second discharge apertures are connected through said downstream circular row fluid conduit means.

21. A bottle filling machine as set forth in claim 20, wherein said valve plate includes a first air inlet port opening to its said bearing surface, said first air inlet port being connected to a source of pressurized air, said first inlet port being located radially in line with a position between said first rinse inlet port and the three o'clock position of said rotational pathway moving clockwise and opening to face said first circular pathway around said rotatable wall of said rotatable valve member and to said first discharge apertures spaced apart radially therein, a first air arcuate distribution groove opening to face said bearing surface of said rotatable wall of said rotatable valve member and extending arcuately in an arcuate pathway corresponding to that of said first circular pathway and first discharge apertures therein of said rotatable valve member, said first air inlet port opening to said first air arcuate distribution groove, pressurized air passing into said first air arcuate distribution groove for discharge through the plurality of said first discharge apertures which come into registration with said first air arcuate distribution groove as they are rotated past and for flowing, while being rotated, pressurized air into said bottles in said upstream circular row to which said first discharge apertures are connected through said upstream circular row conduit means, a second air inlet port through said valve plate opening to its bearing surface and connected to a source of pressurized air, said second air inlet port being radially inward of said first air inlet port, said second air inlet port being located radially in line with a position between said second rinse inlet port and the three o'clock position of said rotational pathway moving clockwise and opening to face said second circular pathway around said rotatable wall of said rotatable valve member and to said second discharge apertures spaced apart radially therein, a second air arcuate distribution groove opening to face said bearing surface of said rotatable wall of said rotatable valve member and extending arcuately in an arcuate pathway corresponding to that of said second circular pathway and second discharge apertures therein of said rotatable valve member, said second air inlet port opening to said second air arcuate distribution groove, pressurized air passing into said second air arcuate distribution groove for discharge through the plurality of said second discharge apertures which come into registration with said second air arcuate distribution groove as they are rotated past and for flowing, while being rotated, pressurized air into said bottles in said downstream circular row to which said second discharge apertures are connected through said downstream circular row conduit means.

22. A bottle filling machine as set forth in claim 19, wherein said valve plate includes a first rinse inlet port opening to its said bearing surface, said first rinse inlet port being connected to a supply of rinse water, said first rinse inlet port being located radially in line with a position about midway between the ten and eleven o'clock positions of said rotational pathway moving clockwise and opening to face said first circular pathway around said rotatable wall of said rotatable valve member and to said first discharge apertures spaced apart radially therein, a first rinse arcuate distribution groove opening to face said bearing surface of said rotatable wall of said rotatable valve member and extending arcuately in an arcuate pathway corresponding to that of said first circular pathway and first discharge apertures therein of the said rotatable valve member, a first end of said first rinse distribution groove being located radially in line with said position about midway between the ten and eleven o'clock positions of said rotational pathway moving clockwise, the opposite end of said first rinse distribution groove being located radially in line with a position about midway between the eleven and twelve o'clock positions of said rotational pathway moving clockwise, said first rinse inlet port opening to said first rinse arcuate distribution groove at its said first end, rinse water passing into said first rinse arcuate distribution groove for discharge through the plurality of said first discharge apertures which come into registration with said first rinse arcuate distribution groove as they are rotated past and for flowing, while being rotated, rinse water into said bottles in said upstream circular row to which said first discharge apertures are connected through said upstream circular row fluid conduit means, a second rinse inlet port through said valve plate opening to its said bearing surface and connected to a supply of rinse water, said second rinse inlet port being radially inward from said first rinse inlet port, said second rinse inlet port being located radially in line with a position about midway between the said ten and eleven o'clock position of said rotational pathway moving clockwise and opening to face said second circular pathway around said rotatable wall of said rotatable valve member and to said second discharge apertures spaced apart radially therein, a second rinse arcuate distribution groove opening to face said bearing surface of said rotatable wall of said rotatable valve member and extending arcuately in an arcuate pathway corresponding to that of said second circular pathway and second discharge apertures therein of said rotatable valve member, a first end of said second rinse distribution groove being located radially in line with said position about midway between the ten and eleven o'clock positions of said rotational pathway moving clockwise, the opposite end of said second rinse distribution groove being located radially in line with a position about midway between the eleven and twelve o'clock positions of said rotational pathway moving clockwise, said second rinse inlet port opening to said second rinse arcuate distribution groove at its said first end, rinse water passing into said second rinse arcuate distribution groove for discharge through the plurality of said second discharge apertures which come into registration with said second rinse arcuate distribution groove as they are rotated past and for flowing, while being rotated, rinse water into said bottles in said downstream circular row to which said second discharge apertures are connected through said downstream circular row fluid conduit means.

23. A bottle filling machine as set forth in claim 22, wherein said valve plate includes a first air inlet port opening to its said bearing surface, said first air inlet port being connected to a source of pressurized air, said first inlet port being located radially in line with a position about midway between the one and two o'clock positions of said rotational pathway moving clockwise and opening to face said first circular pathway around said rotatable wall of said rotatable valve member and to said first discharge apertures spaced apart radially therein, a first air arcuate distribution groove opening to face said bearing surface of said rotatable wall of said rotatable valve member and extending arcuately in an arcuate pathway corresponding to that of said first circular pathway and first discharge apertures therein of said rotatable valve member, a first end of said first air arcuate distribution groove being located radially in line with a position about midway between the twelve and one o'clock positions of said rotational pathway moving clockwise, the opposite end of said first arcuate distribution groove being located radially in line with a position about midway between the one and two o'clock positions of said rotational pathway moving clockwise, said first air inlet port opening to said first air arcuate distribution groove at its said opposite end, pressurized air passing into said first air arcuate distribution groove for discharge through the plurality of said first discharge apertures which come into registration with said first air arcuate distribution groove as they are rotated past and for flowing, while being rotated, pressurized air into said bottles in said upstream circular row to which said first discharge apertures are connected through said upstream circular row fluid conduit means, a second air inlet port through said valve plate opening to its bearing surface and connected to a source of pressurized air, said second air inlet port being radially inward of said first air inlet port, said second air inlet port being located radially in line with a position about midway between the one and two o'clock positions of said rotational pathway moving clockwise and opening to face said second circular pathway around said rotatable wall of said rotatable valve member and to said second discharge apertures spaced apart radially therein, a second air arcuate distribution groove opening to face said bearing surface of said rotatable wall of said rotatable valve member and extending arcuately in an arcuate pathway corresponding to that of said second circular pathway and second discharge apertures therein of said rotatable valve member, a first end of said second air arcuate distribution groove being located radially in line with a position about midway between the twelve and one o'clock positions of said rotational pathway moving clockwise, the opposite end of said second air arcuate distribution groove being located radially in line with a position about midway between the one and two o'clock positions of said rotational pathway moving clockwise, said second air inlet port opening to said second air arcuate distribution groove at its said opposite end, pressurized air passing into said second air arcuate distribution groove for discharge through the plurality of said second discharge apertures which come into registration with said second air arcuate distribution groove as they are rotated past and for flowing, while being rotated, pressurized air into said bottles in said downstream circular row to which said second discharge apertures are connected through said downstream circular row fluid conduit means.

* * * * *